United States Patent [19]

Stotler et al.

[11] Patent Number: 4,601,741

[45] Date of Patent: Jul. 22, 1986

[54] METHOD AND APPARATUS FOR PRODUCING A CONTINUOUS GLASS FILAMENT MAT

[75] Inventors: David V. Stotler; Fred S. Coffey, both of Newark, Ohio

[73] Assignee: Owens-Corning Fiberglas Corporation, Toledo, Ohio

[21] Appl. No.: 721,019

[22] Filed: Apr. 8, 1985

[51] Int. Cl.[4] ..... C03B 37/06

[52] U.S. Cl. ..... 65/4.4; 65/5; 65/9; 65/16

[58] Field of Search ..... 65/4.4, 9, 5, 16

[56] References Cited

U.S. PATENT DOCUMENTS

| | | | |
|---|---|---|---|
| 3,393,985 | 7/1968 | Langlois | 65/9 |
| 4,345,927 | 8/1982 | Picone | 65/4.4 |
| 4,496,384 | 1/1985 | Lin | 65/4.4 |
| 4,496,385 | 1/1985 | Lin . | |
| 4,515,613 | 5/1985 | Stotler et al. | 65/4.4 |

*Primary Examiner*—Robert Lindsay

*Attorney, Agent, or Firm*—Ronald C. Hudgens; Greg Dziegielewski

[57] ABSTRACT

A method and apparatus for producing a mat of highly dispersed continuous glass filaments at increased throughput while maintaining desirable tensile strength characteristics by means of an oscillatable, fluidic distribution system.

5 Claims, 5 Drawing Figures

METHOD AND APPARATUS FOR PRODUCING A CONTINUOUS GLASS FILAMENT MAT

TECHNICAL FIELD

The invention disclosed herein relates to the production of mats comprised of strands of highly dispersed, continuous glass filaments arranged in an overlapping, interengaging swirled relationship.

BACKGROUND

As with many other processes, the desire to increase the throughput and efficiency of present systems for producing continuous strand mats has been felt. The physical properties of the mat can be greatly affected by increasing the throughput of the feeder, especially in those processes wherein, contemporaneously, continuous glass filaments are produced, gathered into a plurality of bundles and deposited on a moving conveyor as a mat wherein the bundles or strands arranged in a planar array are oscillated back and forth across the width of the conveyor.

For example, by merely increasing the throughput of the fiber forming feeder, the mat produced may have more tensile strength in the cross machine direction as opposed to the machine direction.

The present invention provides a system wherein the throughput of the system can be increased while achieving the desired tensile strength characteristics in a highly dispersed or filamentized mat of continuous glass filaments.

DISCLOSURE OF THE INVENTION

The invention pertains to method and apparatus for forming a mat of continuous glass filaments comprising: drawing streams of molten glass into continuous filaments; orienting said filaments as a substantially planar band of substantially parallel bundles of filaments; contacting said band with a substantially planar gaseous stream; providing a first control surface and a second control surface, said control surfaces forming a divergent section and a convergent section to reduce the velocity of the gaseous stream and to impart lateral movement to some of said filaments to advance said filaments as a diverging planar array having a width at an after-defined collection surface at least 6 times the width of the band at the point of initial contact with said gaseous stream; positioning a perturbation means between the first and second control surfaces to establish turbulent flow of the gas, disassociate said bundles into substantially individual filaments or small groups of filaments; moving the diverging planar array back and forth across the width of the mat; and collecting said filaments as said mat.

BEST MODE OF CARRYING OUT THE INVENTION

Figure 1:
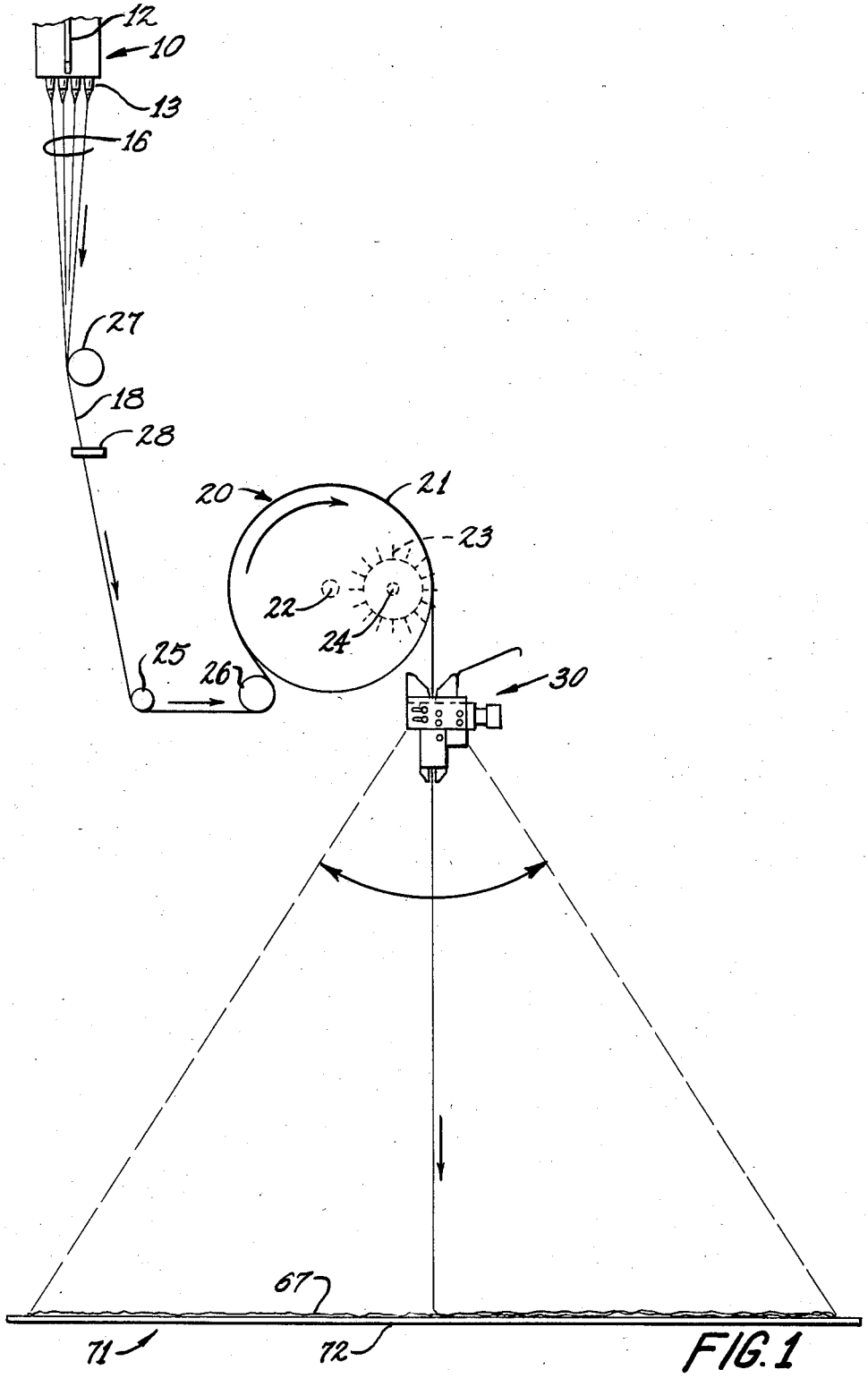
FIG. 1 is an elevational view of a fiber and mat producing system according to the principles of this invention.

As shown in FIG. 1, electrically heated feeder means 10 supplies a plurality of streams of molten inorganic material, such as glass, which are attenuated or drawn into a plurality of continuous filaments 16 through the action of attenuation means 20. Feeder 10 may be of any suitable design. As shown, feeder 10 is equipped with a pair of terminals 12 which are connected to a source of electrical energy (not shown). Further, the discharge or bottom wall is equipped with a plurality of orificed projections 13 to supply the streams of molten material, as is known in the art.

Intermediate feeder 10 and attenuation means 20, a coating means 27 supplies a protective coating or size to the advancing filaments. Downstream of size applicator 27, guide or multi-grooved gathering shoe 28 gathers the plurality of filaments into a plurality of strands or bundles having a plurality of filaments in each strand. Preferably, each strand has about the same number of filaments therein. Also, guide 28 orients the strands into a planar band 18 wherein the strands are spaced apart but substantially parallel to each other.

Attenuation means 20 is comprised of a driven pull roll or wheel 21 having an axis of rotation 22, and spaced therefrom, a spoked wheel or carriage 23 having an axis of rotation 24 which is substantially parallel to axis of rotation 22. Spoked wheel 23 is positioned within pull wheel 21, and the extremities of spoked wheel 23 extend through slots in the circumferential periphery of pull wheel 21 to disengage the band 18 from the surface thereof at a predetermined point. As such, the axes of rotation 22 and 24 are fixed. The circumferential surface of pull wheel 21 is substantially flat and is adapted to maintain the band of strands 18 in a substantially spaced apart but parallel relationship. Idler rolls 25 and 26 serve to orient the band 18, as desired. Desirably, roll 25 has a plurality of parallel circumferential grooves to assist in separating the filament into an array of parallel bundles or strands.

Advancing from the surface of pull wheel 21, the band of strands 18 is oscillated across the width of endless foraminous belt 72 of collection means or conveyor 71 to form mat or fibrous body 67 thereon by distribution system 30. As shown in FIG. 1, the axis of rotation 22 is substantially parallel to the path of advancement (perpendicular to the plane of FIG. 1) of belt 72, or in other words, a lateral edge of mat 67.

Usually, a single conveyor 71 will be served by a series of feeders, pull wheels and distribution devices (i.e., plurality of "positions") wherein a plurality of diverging planar arrays of strands are deposited across the width of the conveyor to produce a mat 67 of continuous glass strands and/or filaments arranged in overlapping, interengaging, looping or swirled orientation.

Distribution means 30 is comprised of blower section 32 and first and second members 42 and 50. Blower section 32 is adapted to provide a substantially uniform planar gaseous stream to contact the band of strands 18 to advance them towards belt 72 in a predetermined manner. First and second members 42 and 50 assist in controlling the gaseous stream such that the planar array of advancing strand 65 advances toward collection means 71 in a diverging relationship. As the advancing strands contact the conveyor and/or mat surface, buckling of the strands to form the loops therein is achieved.

Preferably, the design of the instant distribution means generally employs the principles set forth in our U.S. Pat. No. 4,515,613 granted May 7, 1985 which is hereby incorporated by reference. The present invention incorporates a projection along control surface 43 for creating turbulent flow in the distribution means to even more disassociate the filaments from their bundled state to produce a mat of highly dispersed, continuous filaments. Further, the planes containing control surfaces 43 and 51 are preferably convergent as opposed to being preferably oriented divergently in the aforementioned patent application.

According to the principles of this invention, a diverging planar array of individual filaments or strands comprised of a smaller number of filaments than the strands entering the distribution means 65 may exhibit a width at the collection surface 72 within the range from about 4 to about 18 times the width of the band of strands 18 entering inlet 55 of distribution means 30. Such bundles of filaments exiting the distribution means 30 comprised of a substantially smaller number of filaments than the bundles entering distribution means 30, will be, for the purposes of this discussion, termed "mini-strands" or "mini-bundles". Preferably, the width of the diverging array 65 at collection surface 72 is at least six times the width of band 18 at inlet 55, and, more preferably, the width of diverging array 65 at collection surface 72 is within the range from about 6 to about 10 times the width of band 18.

Figure 2:
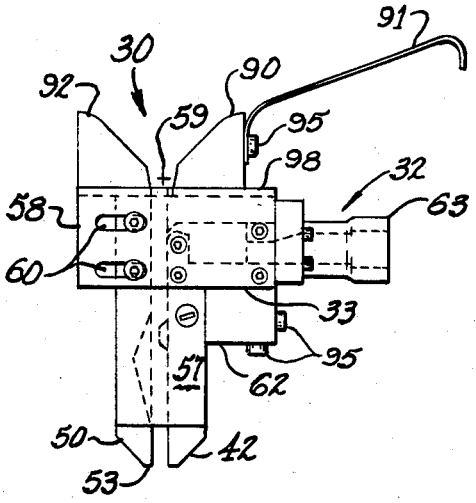
FIG. 2 is an enlarged view of the distribution means shown in FIG. 1.
Figure 3:
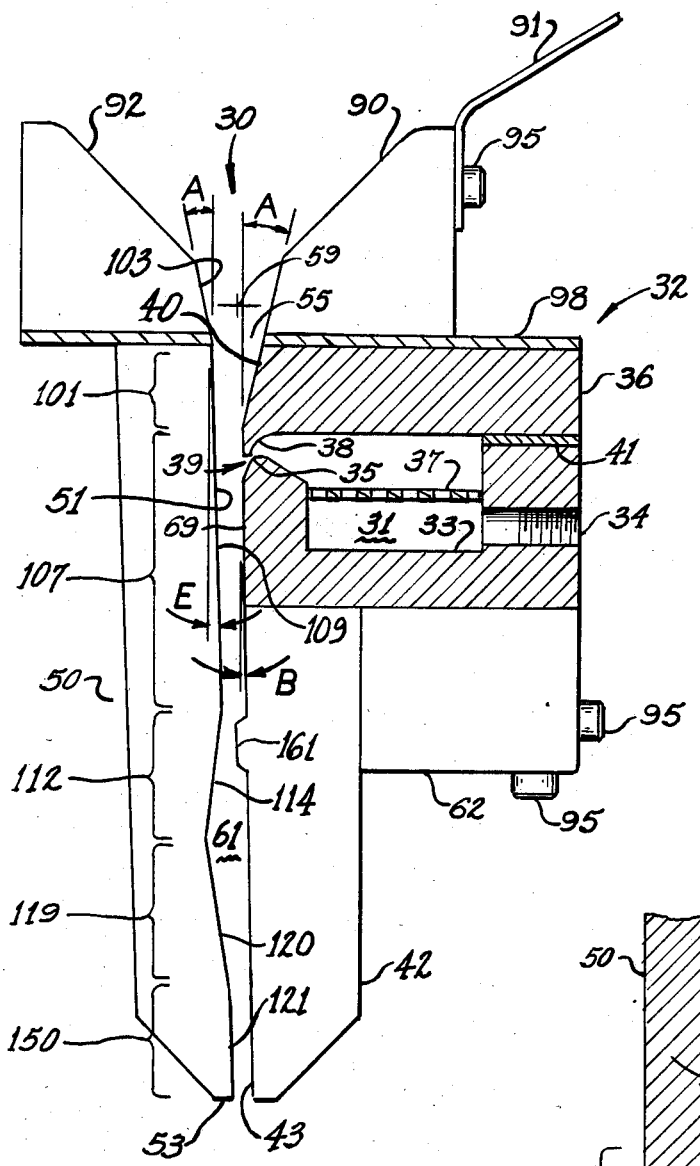
FIG. 3 is an enlarged cross-sectional view of the distribution means shown in FIG. 2.
Figure 5:
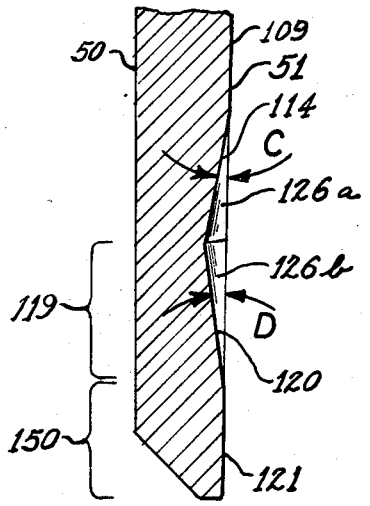
FIG. 5 is an enlarged view of a portion of the distribution means shown in FIG. 3.

As shown in FIGS. 2 and 3, distribution means 30 is comprised of blower section 32 having a body 33 joined, in part, to first member 42 and cap section 36 which are fastened together by any suitable means such as threaded fasteners. Chamber 31 formed therein may include a foraminous member or screen 37 positioned therein to assist in diffusing the pressurized gas, such as air, supplied through inlet 34 from a suitable source (not shown) to provide a substantially uniform velocity profile along the width of nozzle 39.

Contoured end 35 of body 33 is positioned adjacent contoured lip 38 of cap section 36 to form nozzle portion 39 therebetween to supply the planar, high velocity gaseous stream. Control surfaces 43 and 51 of first and second members 42 and 50, respectively, assist in the control of the working fluid to direct the strands as a diverging planar array according to the principles of this invention. During operation, nozzle portion 39 delivers a substantially planar gaseous stream substantially parallel to the path of advancement of the band of filaments 18 between members 42 and 50 to, among other things, maintain proper tension upon band 18 between distribution means 30 and pull wheel 21.

Control surface 51 is spaced from the contoured lip 38 and control surface 43 to form a control chamber 61. Control chamber 61 is comprised of a slot shaped inlet 55, a tapered inlet section 101, throat section 107, a divergent section 112, a convergent section 119 and an outlet section 150. Slotted inlet 55 forms one end of tapered inlet section 101 which is in communication with throat section 107, which is in communication with divergent section 112 which, in turn, is in communication with convergent section 119. Chambered section 61 terminates with outlet section 150 which is in communication with convergent section 119. Nozzle portion 39 is in communication with throat section 107 to direct the high velocity planar gaseous stream into contact with the bundles of filaments in throat section 107. As shown, the planes that generally define control surfaces 43 and 51 and, thus, chamber 61 are convergent. That is, the distance between the control surfaces is wider at the inlet section 101 than at outlet section 150.

As shown in FIG. 3, front surface 40 of cap 36 and beveled portion 103 of second deflector 92 are inclined with respect to an assumed vertical line at an angle "A" to form tapered inlet section 101 of chamber 61. Preferably, angles A are within the range from about 0° to about 20°, thus producing a total included angle range from about 0° to about 40°. As shown in FIG. 3, angles A are approximately 10°, which thus yield a total included angle of about 20°.

Figure 4:
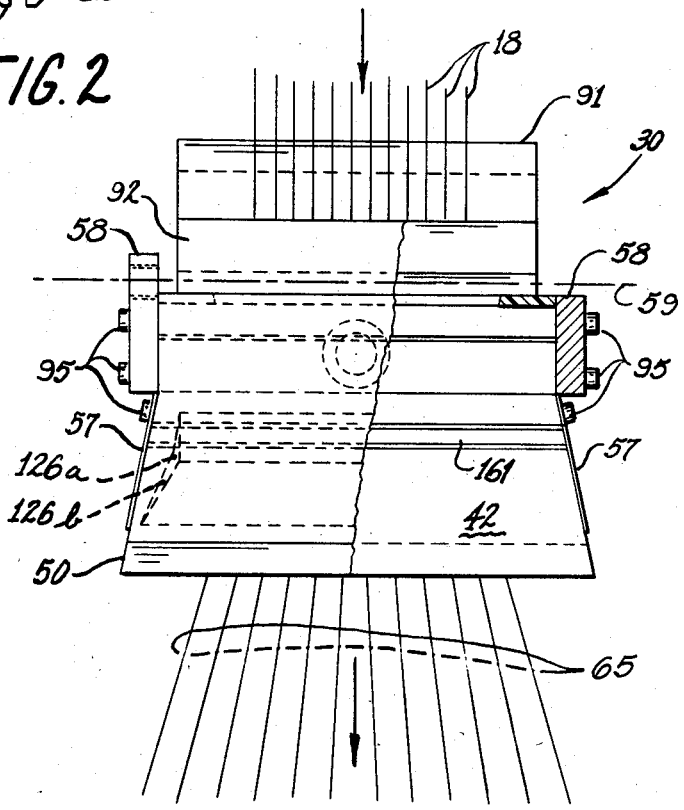
FIG. 4 is a side view of the distribution means shown in FIG. 2.

First member 42 is fixedly joined to body 33 by means of block 62 and fasteners 95. Control surface 43 of first member 42 is substantially planar or flat, except for flow perturbation means which is adapted to create a highly turbulent flow of air at that point to break up the bundles of filaments into mini-bundles or even into individual filaments. Conveniently, flow perturbation means is comprised of a projection 161 extending into control chamber 61. Projection 161 may be of any suitable shape, and the trapezoidal configuration shown in FIGS. 3 and 4 has been found to be very effective in "de-bundling" the groups of continuous filaments.

As shown, projection 161 is located opposite divergent second surface 114 of second member 50 and extends substantially completely across chamber 61.

Preferably, projection 161 is located along the control surface extending from face 69 of blower 32 to take advantage of the Coanda Effect to impinge the flow of working fluid directly upon projection 161.

Control surface 51 of second member 50 is defined by first surface 109, second surface 114 and third surface 121. As shown, second member 50 terminates at distal end 53.

Face 69 of body 33 and a portion of control surface 43 of first member 42 form a smooth planar wall opposite first surface 109 of second member 50 to form throat section 107. Face 69, control surface 43 and first surface 109 are, generally, slightly angled to form a slightly convergent throat section. As shown in FIG. 3, face 69 and control surface 43 form an angle "B" with respect to an assumed vertical reference line. Preferably, angle B is within the range from about 0° to about 5°. As shown, angle B is about 1°.

To form the generally convergent control chamber 61, second control surface 51 is angled toward first control surface 43. Control surface 51, with the exception of convergent and divergent sections 119 and 112, forms an angle "E" with respect to an assumed vertical reference line. Preferably, angle "E" is within the range from about 1° to about 6°. As shown, angle "E" is about 1.7°.

Divergent section 112 is formed in part by control surface 43 of first member 42 and second surface 114 of second member 50. Second surface 114 diverges at an angle "C" from the assumed vertical reference line within the range from about 5° to about 20°. As shown, angle C is about 10°.

Convergent section 119 is formed between part of control surface 43 of first member 42 and third surface 121 of second member 50. Third surface 121 forms an angle "D" with respect to the assumed vertical reference line within the range from about 5° to about 25°. As shown in FIG. 3, angle "D" is about 5°.

As shown, second surface 114 and third surface 121 form a "shovel-shaped" recess in the plane of first surface 109 of control surface 51 of second member 50. Second surface 114 terminates at beveled lateral surfaces 126*a*, and third surface 121 terminates at beveled surfaces 126*b*. Lateral surfaces 126*b* are divergent with respect to each other. Further, contiguous surface 126*a* and surface 126*b* are angled with respect to each other to form a "double-beveled" lateral surface at each end of the divergent and convergent sections. Thus, the control surfaces 43 and 51 are configured to direct the gaseous stream laterally outward to impart lateral movement to the "de-bundled" strands of filaments to issue the filaments as a diverging planar array of mini-strands and/or individual filaments 65.

The diverging/converging configuration of sections 112 and 119 of the control chamber 61 reduces the velocity of the gaseous stream exiting from distribution means 30 to permit the distribution means 30 to be placed closer to collection means 71 than would generally be possible without such a configuration and imparts lateral movement to the bundles of filament to eject the bundles of filaments from distribution means 30 as a diverging planar array of bundles. The perturbation means de-bundles or filamentizes the groups of filaments to produce a mat of continuous, highly dispersed filaments and/or mini-strands.

Additionally, a first deflector means 90 and a second deflector means 92, are joined at cap section 36 and second member 50, respectively, to assisting guiding band 18 into inlet 55. As shown in FIGS. 2 and 3, plate 98 having a slot conforming to inlet 55 is fastened to first and second deflector means 90 and 92 and cap 36 to locate deflectors 90 and 92 at inlet 55.

Extension 91, which projects laterally and upwardly from first deflector 90, guides "heavy" bundles of strand that may be thrown off pull wheel 21 at too early of a point into inlet 55.

Preferably, distributor means 30 and air supply header 63, which is in communication with inlet 34, is made from lightweight materials, such as aluminum, to reduce the mass of the system that must be reciprocably moved. Coatings may be applied to the strand contacting surfaces to reduce friction and surface wear and filament abrasion, if desired.

A pair of end plates 57 are fastened to first member 42 and are also in contact with second member 50 by any suitable means, such as threaded fasteners, to further define control chamber 61. Mounting plates 58, at each end of unit 30, secure second member 50 to first member 42 to fix the distance therebetween and enclose blower chamber 37 at the ends thereof. Further, mounting plates 58 include slots 60, to permit adjustment of the space between control surfaces 43 and 51.

Distribution means 30 is pivotable about axis of rotation 59 to direct the gaseous stream and array of strands or filaments back and forth across the width of conveyor belt 72 as shown in FIG. 1. It is preferred that the axis of rotation of the distribution means 30 should be substantially parallel to and in line with the center line of inlet 55 to provide uninterrupted access to distribution means 30 by the band of strands 18 throughout the complete arc of oscillation of distribution means 30. As shown, distribution means 30, which may be driven for movement by any suitable motive means (not shown), is oscillated about an axis substantially parallel to the path of advancement of conveyor belt 72 to distribute the planar array of strands 65 across the width of mat 67. However, it is to be understood that the axis of rotation of distribution means 30 may be obliquely oriented with respect to the path of advancement of belt 72 to produce a mat of different physical characteristics, if desired.

As is known in the art, mat 67 may receive a suitable binder to adhere the strands and filaments to one another to form a unitary fibrous body. For example, see U.S. Pat. Nos. 3,442,751 and 2,875,503. Or, mat 67 may be needle punched to provide sufficient integrity, as desired.

It is apparent that, within the scope of the present invention, modifications and different arrangements can be made other than as herein disclosed. The present disclosure is merely illustrative with the invention comprehending all variations thereof.

INDUSTRIAL APPLICABILITY

The invention disclosed herein is readily applicable to the glass fiber mat industry.

We claim:

1. Apparatus for producing a mat of continuous glass filaments comprising:

feeder means for supplying a plurality of streams of molten glass;

pull roll means for drawing streams into said filaments, said pull roll having an axis of rotation;

a collection surface for collecting said filaments as said mat;

distribution means having (a) an inlet adapted to receive said plurality of filaments arranged as a substantially planar band of bundles of filaments, said inlet being oriented substantially parallel to the axis of rotation of the pull roll, (b) a blower section adapted to supply a substantially planar high velocity gaseous stream to contact said bundles, (c) a first control surface extending from said blower section, (d) a second control surface opposite said first control surface, and (e) a projection extending into an after-defined divergent section for creating turbulent flow of said gaseous stream within the distribution means to disassociate the bundles of filaments, said first and second control surfaces and said blower section forming (a) a throat section to receive said planar gaseous stream from said blower section; (b) a divergent section extending from said throat section; and (c) a convergent section extending from said divergent section, said divergent section and convergent section being oriented to (i) reduce the velocity of the gaseous stream and advancing filaments and (ii) impart lateral movement to some of the gaseous streams and filaments to advance said filaments as a diverging planar array having a width at said collection surface at least about 4 times the width of the band of filaments entering said inlet; and means for moving said distribution means to deposit the array filaments discharged from distribution means across the width of the mat being formed.

2. The apparatus of claim 1 wherein said projection extends from the first control surface.

3. The apparatus of claim 1 wherein said first control surface is substantially flat.

4. The apparatus of claim 1 wherein the first control surface and the second control surface are generally convergent with respect to each other.

5. A method of producing a mat of continuous glass filaments comprising:

supplying a plurality of streams of molten glass from a feeder means;

drawing the streams into said filaments;

orienting said bundles as a planar band;

passing said planar band through a distribution means having (a) an inlet adapted to receive said plurality of filaments arranged as a substantially planar band of bundles of filaments, said inlet being oriented substantially parallel to the axis of rotation of the pull roll, (b) a blower section adapted to supply a substantially planar high velocity gaseous stream to contact said bundles, (c) a first control surface extending from said blower section, (d) a second control surface opposite said first control surface, and (e) a projection extending into an after-defined divergent section for creating turbulent flow of said gaseous stream within the distribution means to disassociate the bundles of filaments, said first and second control surfaces and said blower section forming (a) a throat section to receive said planar gaseous stream from said blower section; (b) a divergent section extending from said throat section; and (c) a convergent section extending from said divergent section, said divergent section and convergent section being oriented to (i) reduce the velocity of the gaseous stream and advancing filaments and (ii) impart lateral movement to some of the gaseous streams and filaments to advance said filaments as a diverging planar array having a width at said collection surface at least about 4 times the width of the band of filaments entering said inlet;

means for moving said distribution means to deposit the array filaments discharged from distribution means across the width of the mat being formed; and collecting the filaments as said mat.

* * * * *